US010643557B2

(12) United States Patent
Zuo

(10) Patent No.: US 10,643,557 B2
(45) Date of Patent: May 5, 2020

(54) DRIVING DEVICE AND LIQUID CRYSTAL DISPLAY DEVICE

(71) Applicants: Shenzhen China Star Optoelectronics Technology Co., Ltd., Shenzhen (CN); Wuhan China Star Optoelectronics Technology Co., Ltd., Wuhan (CN)

(72) Inventor: Qingcheng Zuo, Shenzhen (CN)

(73) Assignees: SHENZHEN CHINA STAR OPTOELECTRONICS TECHNOLOGY CO., LTD., Shenzhen (CN); WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 182 days.

(21) Appl. No.: 14/897,812

(22) PCT Filed: Sep. 17, 2015

(86) PCT No.: PCT/CN2015/089833
§ 371 (c)(1),
(2) Date: Feb. 12, 2018

(87) PCT Pub. No.: WO2017/041318
PCT Pub. Date: Mar. 16, 2017

(65) Prior Publication Data

US 2018/0218694 A1 Aug. 2, 2018

(30) Foreign Application Priority Data

Sep. 9, 2015 (CN) ..... 2015 1 0572226

(51) Int. Cl.
*G09G 3/36* (2006.01)

(52) U.S. Cl.
CPC ..... *G09G 3/3614* (2013.01); *G09G 3/3648* (2013.01); *G09G 3/3677* (2013.01);
(Continued)

(58) Field of Classification Search
CPC .. G09G 3/20; G09G 3/30; G09G 3/34; G09G 3/36; G09G 5/00; G09G 5/10; G09G 5/18;
(Continued)

(56) References Cited

U.S. PATENT DOCUMENTS

2004/0041763 A1* 3/2004 Kodama ..... G09G 3/3688 345/87
2006/0007195 A1* 1/2006 Hu ..... G09G 3/3648 345/204

(Continued)

*Primary Examiner* — Chanh D Nguyen
*Assistant Examiner* — Nguyen H Truong

(57) ABSTRACT

A driving device and a liquid crystal display device are disclosed. In the driving device, a charging efficiency difference between a positive polarity voltage and a negative polarity voltage on a pixel can be compensated through increasing a duration of a gate driving signal, shortening a time period during which the positive polarity voltage is provided to a source line, and prolonging a time period during which the negative polarity voltage is provided to the source line. In this manner, the technical problem of non-uniform brightness of an image displayed in a traditional liquid crystal display panel and unsatisfactory display effect thereof can be solved.

5 Claims, 3 Drawing Sheets

(52) U.S. Cl.
CPC ... *G09G 2310/067* (2013.01); *G09G 2310/08* (2013.01); *G09G 2320/0219* (2013.01); *G09G 2320/0233* (2013.01)

(58) Field of Classification Search
CPC ..... H03K 3/00; H03K 17/56; H03K 17/687; G02F 1/136; G02F 1/1333; G02F 1/1337; G02F 1/1368; G02F 1/1365; H01L 33/08
See application file for complete search history.

(56) References Cited

U.S. PATENT DOCUMENTS

2006/0290644 A1* 12/2006 Kim ..... G09G 3/3677 345/100
2007/0001991 A1* 1/2007 Jang ..... G09G 3/3677 345/100
2013/0314361 A1* 11/2013 Saitoh ..... G06F 3/0412 345/173
2016/0027387 A1* 1/2016 Park ..... G09G 3/3614 345/691

* cited by examiner

DRIVING DEVICE AND LIQUID CRYSTAL DISPLAY DEVICE

CROSS REFERENCE TO RELATED APPLICATIONS

The present application claims the priority of Chinese patent application CN201510572226.3, entitled "Driving Device and Liquid Crystal Display Device" and filed on Sep. 9, 2015, the entirety of which is incorporated herein by reference.

FIELD OF THE INVENTION

The present disclosure relates to the technical field of display, and particularly to a driving device of a liquid crystal display panel and a liquid crystal display device which comprises a liquid crystal display panel and a driving device.

BACKGROUND OF THE INVENTION

In a Thin Film Transistor Liquid Crystal Display (TFT-LCD), a gate driving signal is generally provided to a gate of each TFT of a pixel region through a gate driving device so as to control an on/off state of the gate. In order to prevent liquid crystal molecules from being polarized, the LCD should be driven by an alternating driving method. At present, the alternating driving method is mainly realized through providing a source driving voltage in which a positive polarity voltage and a negative polarity voltage appear in an alternating manner to a source of the TFT. The source driving voltage comprises the positive polarity voltage and the negative polarity voltage. The positive polarity voltage is a voltage larger than a reference voltage (which is a common voltage in general), while the negative polarity voltage is a voltage smaller than the reference voltage.

FIG. 1 schematically shows a driving device of a traditional liquid crystal display panel. FIG. 2 is a driving time-sequence diagram of the driving device as shown in FIG. 1. FIG. 3 schematically shows polarities of a pixel voltage in a row inversion driving mode. In the row inversion driving mode, a polarity of a pixel corresponding to adjacent gate lines inverses with a row as a unit.

When a frame m is displayed, a polarity of a pixel voltage corresponding to a gate line in row n is positive, and a polarity of a pixel voltage corresponding to a gate line in row n+1 is negative. As shown in FIGS. 1 and 2, when a gate driving voltage is provided to the gate line in row n, transistors T1, T2, . . . in a same row are all turned on. A positive polarity voltage is written in all pixels corresponding to the gate line in row n, and a writing time is t. After the positive polarity voltage is written, the gate driving voltage is provided to a gate line in row n+1. At this time, transistors T3, T4, . . . in this row are turned on, a negative polarity voltage is written in all pixels corresponding to the gate line in row n+1, and a writing time is also t.

A voltage difference between a positive polarity voltage which is written in the pixels corresponding to the gate line in row n and the gate driving voltage of the gate line in row n is seen as a first voltage difference, while a voltage difference between a negative polarity voltage which is written in the pixels corresponding to the gate line in row n+1 and the gate driving voltage of the gate line in row n+1 is seen as a second voltage difference. When the gate is turned on, the first voltage difference is unequal to the second voltage difference. Therefore, the pixels corresponding to the gate line in row n would have a different charging effect from the pixels corresponding to the gate line in row n+1 when they have a same writing time. As a result, an image displayed in the liquid crystal display panel would have a non-uniform brightness, and a display effect thereof would be adversely affected.

SUMMARY OF THE INVENTION

With respect to the technical problem of non-uniform brightness of the image displayed in the traditional liquid crystal display panel and the unsatisfactory display effect thereof, the present disclosure aims to solve this technical problem.

In order to solve the aforesaid technical problem, the present disclosure provides a driving device of a liquid crystal display panel and a liquid crystal display device which comprises the driving device.

According to a first aspect, the present disclosure provides a driving device of a liquid crystal display panel, which comprises:

a plurality of source driving circuits, wherein each source driving circuit is configured to provide a positive polarity voltage or a negative polarity voltage to a source line of the liquid crystal display panel in a row inversion driving mode;

a plurality of gate driving circuits, wherein each gate driving circuit is configured to provide a gate driving signal to a gate line of the liquid crystal display panel; and a control circuit, wherein when a same image frame is displayed, the control circuit enables a first time period during which the positive polarity voltage is provided to the source line to be less than a second time period during which the negative polarity voltage is provided to the source line, and enables a duration during which the gate driving signal is provided to the gate driving circuit to be larger than or equal to the second time period.

Preferably, a sum of the first time period and the second time period is a constant value.

Preferably, a difference between the second time period and the first time period is larger than a preset time threshold.

Preferably, the preset time threshold is larger than a difference between a second charging time and a first charging time. The first charging time is a time during which a pixel is fully charged when the positive polarity voltage serves as a charging voltage, and the second charging time is a time during which the pixel is fully charged when the negative polarity voltage serves as the charging voltage.

Preferably, the control circuit comprises: a plurality of switching elements corresponding to the plurality of gate driving circuits one-to-one, each gate driving circuit providing a gate driving signal to a corresponding gate line through a corresponding switching element; and control units for controlling on/off states of the switching elements.

Preferably, two switching elements corresponding to two adjacent gate driving circuits are an N-type Metal Oxide Semiconductor (NMOS) transistor and a P-type Metal Oxide Semiconductor (PMOS) transistor respectively.

According to a second aspect, the present disclosure provides a liquid crystal display device, which comprises a liquid crystal display panel and a driving device, and the driving device comprises:

a plurality of source driving circuits, wherein each source driving circuit is configured to provide a positive polarity voltage or a negative polarity voltage to a source line of the liquid crystal display panel in a row inversion driving mode;

a plurality of gate driving circuits, wherein each gate driving circuit is configured to provide a gate driving signal to a gate line of the liquid crystal display panel; and a control circuit, wherein when a same image frame is displayed, the control circuit enables a first time period during which the positive polarity voltage is provided to the source line to be less than a second time period during which the negative polarity voltage is provided to the source line, and enables a duration during which the gate driving signal is provided to the gate driving circuit to be larger than or equal to the second time period.

Preferably, a sum of the first time period and the second time period is a constant value. A difference between the second time period and the first time period is larger than a preset time threshold.

Preferably, the preset time threshold is larger than a difference between a second charging time and a first charging time. The first charging time is a time during which a pixel is fully charged when the positive polarity voltage serves as a charging voltage, and the second charging time is a time during which the pixel is fully charged when the negative polarity voltage serves as the charging voltage.

Preferably, the control circuit comprises: a plurality of switching elements corresponding to the plurality of gate driving circuits one-to-one, each gate driving circuit providing a gate driving signal to a corresponding gate line through a corresponding switching element, and two switching elements corresponding to two adjacent gate driving circuits being an NMOS transistor and a PMOS transistor respectively; and control units for controlling on/off states of the switching elements.

Compared with the prior art, one embodiment or a plurality of embodiments according to the present disclosure may have the following advantages or beneficial effects.

In the driving device according to the present disclosure, a charging efficiency difference between the positive polarity voltage and the negative polarity voltage on the pixel can be compensated through increasing the duration of the gate driving signal, shortening the time period during which the positive polarity voltage is provided to the source line, and prolonging the time period during which the negative polarity voltage is provided to the source line. In this manner, in the driving device according to the present disclosure, the technical problem of non-uniform brightness of the image displayed in the traditional liquid crystal display panel and the unsatisfactory display effect thereof can be solved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

In order to solve the technical problem of non-uniform brightness of the image displayed in the traditional liquid crystal display panel and the unsatisfactory display effect thereof, the embodiment of the present disclosure provides a driving device of a liquid crystal display panel.

Figure 4:
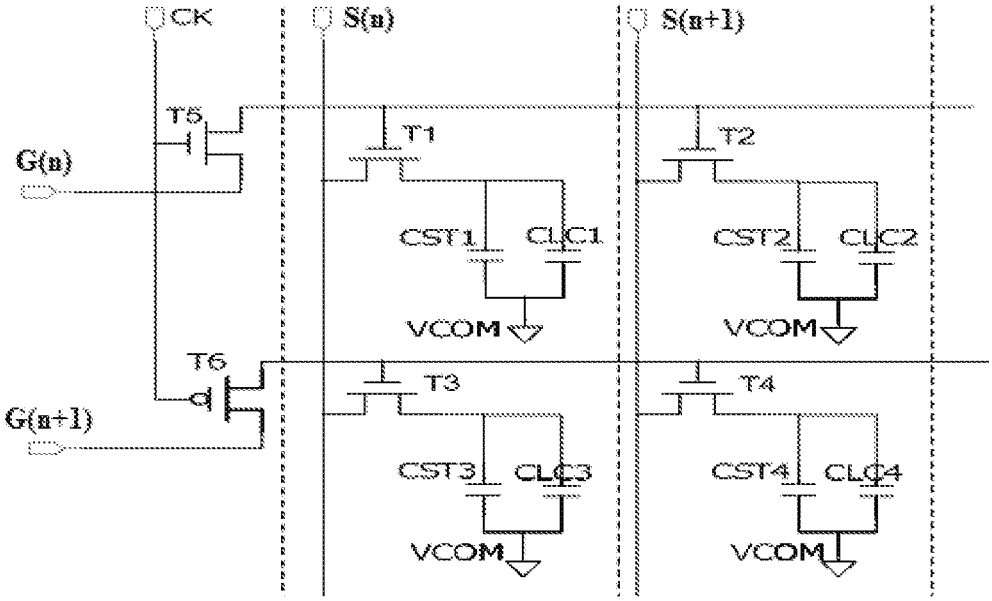
FIG. 4 schematically shows a driving device of a liquid crystal display panel according to one embodiment of the present disclosure.

FIG. 4 schematically shows a driving device of a liquid crystal display panel according to the embodiment of the present disclosure. According to the present embodiment, the driving device mainly comprises a plurality of source driving circuits, a plurality of gate driving circuits, and a control circuit.

Figure 1:
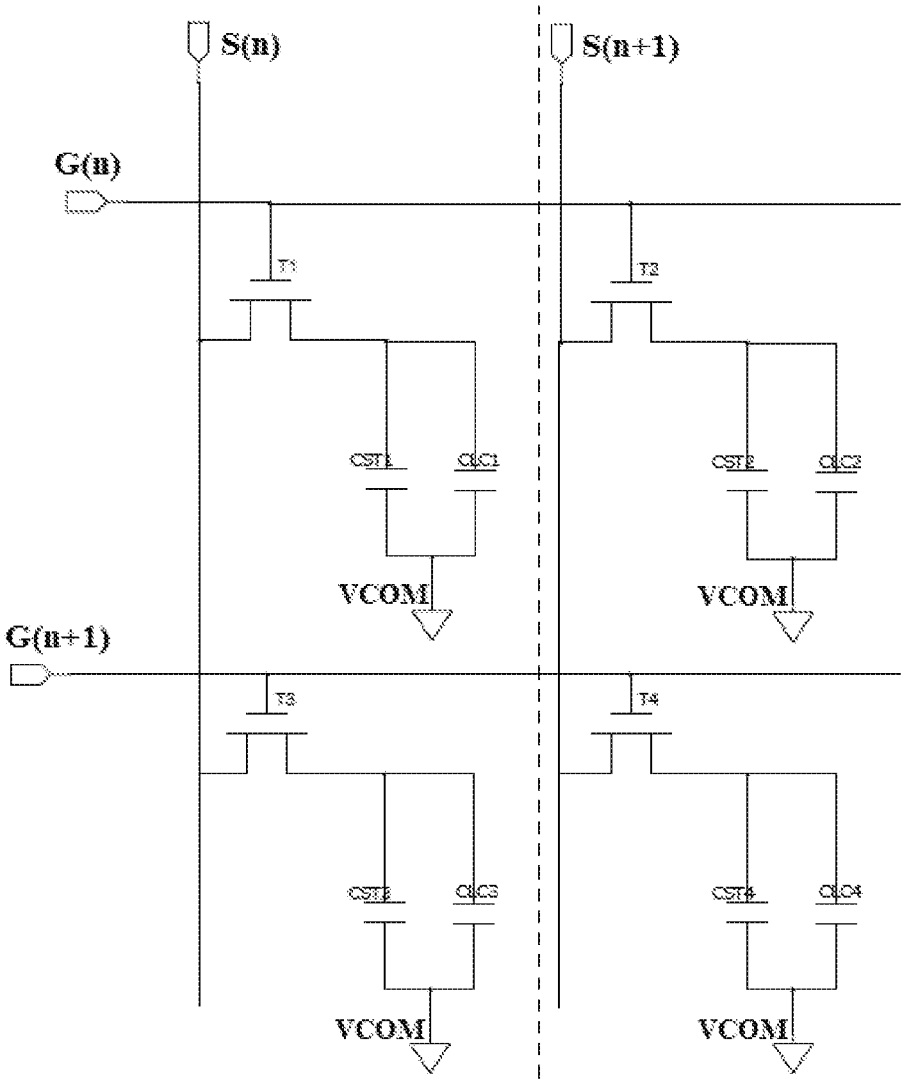
FIG. 1 schematically shows a driving device of a traditional liquid crystal display panel.
Figure 2:
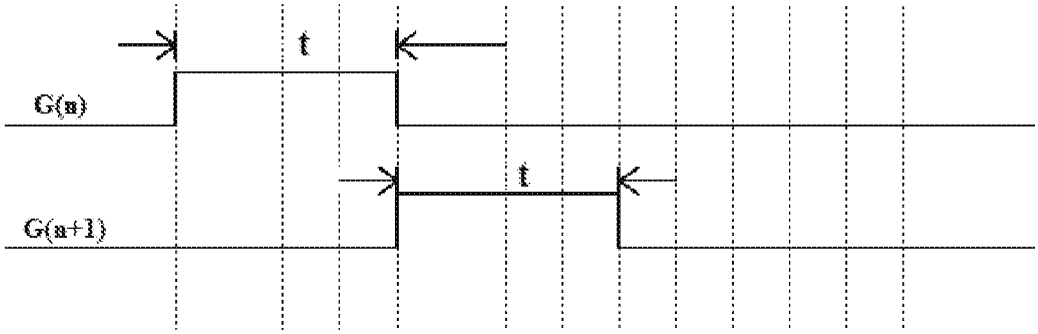
FIG. 2 is a driving time-sequence diagram of the driving device as shown in FIG. 1.
Figure 3:
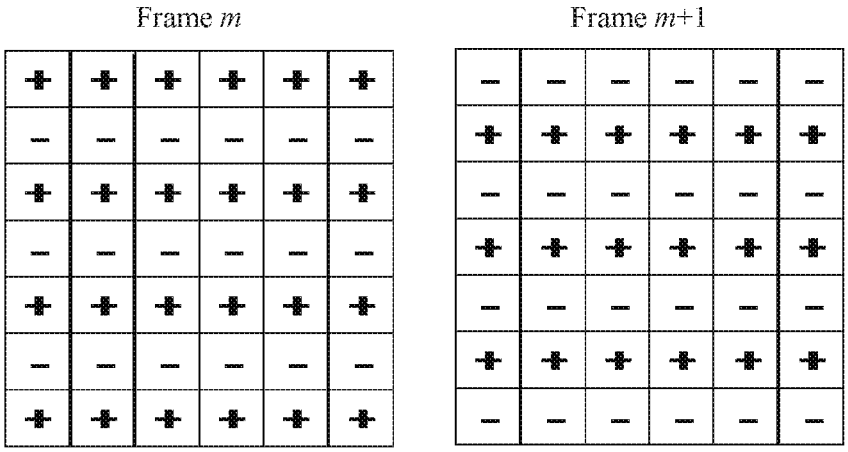
FIG. 3 schematically shows polarities of a pixel voltage in a row inversion driving mode.

Specifically, each source driving circuit is configured to provide a positive polarity voltage or a negative polarity voltage to a source line of the liquid crystal display panel in a row inversion driving mode. The polarities of a pixel voltage in a row inversion driving mode are shown in FIG. 3. Taking two adjacent gate lines as an example, when frame m is displayed, a positive polarity voltage is written in all pixels corresponding to the gate line in row n, and then a negative polarity voltage is written in all pixels corresponding to the gate line in row n+1. When frame m+1 is displayed, a negative polarity voltage is written in all pixels corresponding to the gate line in row n, and then a positive polarity voltage is written in all pixels corresponding to the gate line in row n+1.

Each gate driving circuit provides a gate driving signal to a gate line of the liquid crystal display panel. The gate driving signal is used for turning on a corresponding gate line.

The control circuit enables a first time period during which the positive polarity voltage is provided to the source line is less than a second time period during which the negative polarity voltage is provided to the source line when one frame image is displayed. Compared with the technical solution in the prior art, i.e., the first time period during which the positive polarity voltage is provided to the source line is equal to the second time period during which the negative polarity voltage is provided to the source line, in the control circuit according to the present embodiment, the first time period during which the positive polarity voltage is provided to the source line is shortened, while the second time period during which the negative polarity voltage is provided to the source line is prolonged. Since a first voltage difference between the positive polarity voltage and the gate driving voltage is larger than a second voltage difference between the negative polarity voltage and the gate driving voltage, according to the present embodiment, a charging difference between the positive polarity voltage and the negative polarity voltage on the pixel can be compensated through shortening a charging time of the positive polarity voltage on the pixel and prolonging a charging time of the negative polarity voltage on the pixel. When the charging difference between the positive polarity voltage and the negative polarity voltage on the pixel is compensated, the phenomenon of non-uniform brightness of the image displayed in the traditional liquid crystal display panel and the unsatisfactory display effect thereof can be eliminated.

In addition, in order to maintain the turned-on state of a corresponding gate line when the negative polarity voltage is provided to the source line, a duration during which the gate driving signal is provided to the gate driving circuit should be increased. That is, an output width of the gate driving signal should be widened. According to the present embodiment, the duration during which the gate driving signal is provided to the gate driving circuit is larger than or equal to the second time period during which the negative polarity voltage is provided to the source line. That is, there is an overlap between the duration during which the gate driving signal is provided to one of two adjacent gate lines and the duration during which the gate driving signal is provided to the other one of two adjacent gate lines. An overlapping time should be larger than or equal to a difference between the second time period and the first time period.

According to one preferred embodiment of the present disclosure, a sum of the first time period and the second time period is a constant value. In this manner, the sum of the first time period during which the positive polarity voltage is provided to a pixel and the second time period during which the negative polarity voltage is provided to the pixel does not change, while a proportion of the first time period or the second time period to the sum thereof can change.

According to one preferred embodiment of the present disclosure, a difference between the second time period and the first time period is larger than a preset time threshold. Specifically, the preset time threshold is larger than a difference between a second charging time and a first charging time. Here, the first charging time is a time during which a pixel is fully charged when the positive polarity voltage serves as a charging voltage, and the second charging time is a time during which a pixel is fully charged when the negative polarity voltage serves as a charging voltage.

When the difference between the second time period and the first time period meets the above condition, the pixel can be fully charged by the positive polarity voltage and the negative polarity voltage. According to the present embodiment, the charging difference between the positive polarity voltage and the negative polarity voltage on the pixel can be compensated, and the phenomenon of non-uniform brightness of the image displayed in the traditional liquid crystal display panel and the unsatisfactory display effect thereof can be eliminated.

As shown in FIG. 4, according to one preferred embodiment of the present disclosure, the control circuit comprises control units and a plurality of switching elements. Each switching element corresponds to one gate driving circuit. The control units are used for controlling on/off states of the switching elements. Each gate driving circuit is electrically connected with a corresponding gate line through a corresponding switching element and provides a corresponding gate driving signal to the gate line. Specifically, the switching element is preferably a transistor. Two switching elements corresponding to two adjacent gate driving circuits are an N-type Metal Oxide Semiconductor (NMOS) transistor and a P-type Metal Oxide Semiconductor (PMOS) transistor respectively.

Figure 5:
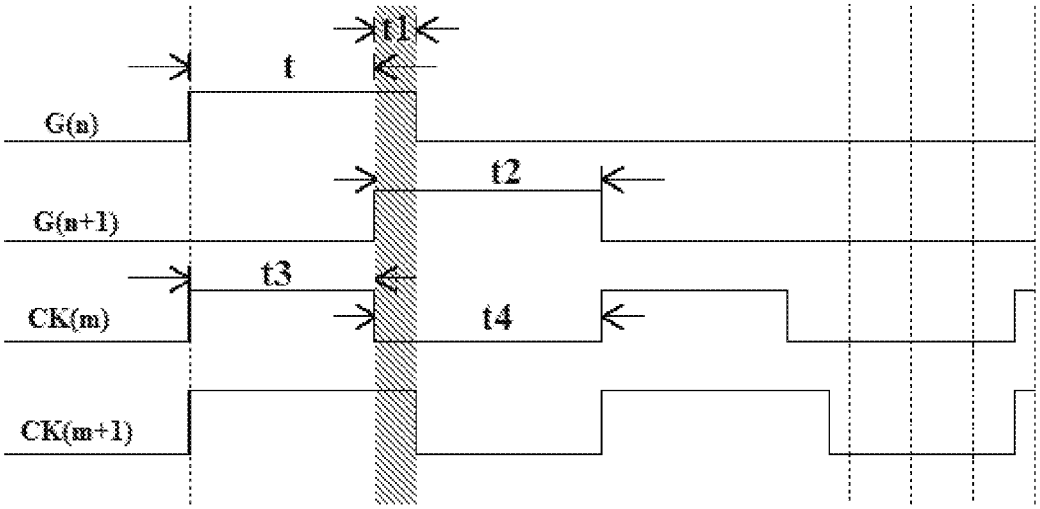
FIG. 5 is a driving time-sequence diagram of the driving device as shown in FIG. 4.

An operational procedure of the driving device according to the embodiment of the present disclosure will be illustrated in detail hereinafter taking a pair of gate lines (i.e., a gate line in row n and a gate line in row n+1) as an example. As shown in FIGS. 4 and 5, the operational procedure of the driving device mainly comprises following step 1 to step 7.

In step 1, when frame m is displayed, a clock signal CK(m) provided by the control unit is in a high-level state, so that an NMOS transistor T5 is turned on, while a PMOS transistor T6 is turned off. The gate line G(n) in row n is in a high-level state. At this time, transistors T1 and T2 are both turned on, and a duration thereof is t2. Here, t2=t+t1, wherein t1 is the overlapping time of G(n) and G(n+1). At this time, the negative polarity voltage is provided to the source lines S(n) and S(n+1). Since other gate lines are all in a turned-off state, only pixels in row n can be charged. A time during which the pixels in row n are charged depends on a time during which CK(m) is in the high-level state. According to the present embodiment, the time during which the pixels in row n are charged is t3, i.e., the first time period.

In step 2, after the pixels in row n are charged. CK(m) is changed into a low-level state. At this time, the NMOS transistor T5 is turned off, while the PMOS transistor T6 is turned on. The gate line G(n+1) in row n+1 is in a high-level state, and transistors T3 and T4 are both turned on. At this time, the positive polarity voltage is provided to the source lines S(n) and S(n+1), and an effective charging time thereof is t4, i.e., the second time period.

In step 3, the above step 1 and step 2 are repeated until the display of frame m is completed.

In step 4, when frame m+1 is displayed, a clock signal CK(m+1) provided by the control unit is in a high-level state. Transistors T1, T2, and T5 are all turned on. At this time, the positive polarity voltage is provided to the source lines S(n) and S(n+1), and an effective charging time thereof is the second time period t4.

In step 5, after the pixels in row n are charged, CK(m+1) is changed into a low-level state. At this time, the NMOS transistor T5 is turned off, while the PMOS transistor T6 is turned on. The gate line G(n+1) in row n+1 is in a high-level state, and transistors T3 and T4 are both turned on. At this time, the negative polarity voltage is provided to the source lines S(n) and S(n+1), and an effective charging time thereof is the first time period t3.

In step 6, the above step 4 and step 5 are repeated until the display of frame m+1 is completed.

In step 7, the frame images are displayed in an alternating manner, so that images can be displayed in the liquid crystal display panel.

Accordingly, the embodiment of the present disclosure further provides a liquid crystal display device, which comprises a liquid crystal display panel and the aforesaid driving device. Since the structure of the driving device is illustrated in detail hereinabove, the details of the liquid crystal display device are no longer repeated here.

In the driving device according to the embodiment of the present disclosure, a charging efficiency difference between the positive polarity voltage and the negative polarity voltage on the pixel can be compensated through increasing the duration of the gate driving signal, shortening the time period during which the positive polarity voltage is provided to the source line, and prolonging the time period during which the negative polarity voltage is provided to the source line. In this manner, in the driving device according to the present disclosure, the technical problem of non-uniform brightness of the image displayed in the traditional liquid crystal display panel and the unsatisfactory display effect thereof can be solved.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A driving device of a liquid crystal display panel, comprising:

a plurality of source driving circuits, wherein each source driving circuit is configured to provide a positive polarity voltage or a negative polarity voltage to a source line of the liquid crystal display panel in a row inversion driving mode;

a plurality of gate driving circuits, wherein each gate driving circuit is configured to provide a gate driving signal to a gate line of the liquid crystal display panel; and a control circuit, wherein when a same image frame is displayed, the control circuit enables a first time period during which the positive polarity voltage is provided to the source line to be less than a second time period during which the negative polarity voltage is provided to the source line, and enables a duration during which the gate driving signal is provided to the gate driving circuit to be larger than or equal to the second time period;

wherein a sum of the first time period and the second time period is a constant value;

a difference between the second time period and the first time period is larger than a preset time threshold;

wherein the preset time threshold is larger than a difference between a second charging time and a first charging time; and wherein the first charging time is a time during which a pixel is fully charged when the positive polarity voltage serves as a charging voltage, and the second charging time is a time during which the pixel is fully charged when the negative polarity voltage serves as the charging voltage.

2. The driving device according to claim 1, wherein the control circuit comprises:

a plurality of switching elements corresponding to the plurality of gate driving circuits one-to-one, each gate driving circuit providing a gate driving signal to a corresponding gate line through a corresponding switching element; and control units for controlling on/off states of the switching elements.

3. The driving device according to claim 2, wherein two switching elements corresponding to two adjacent gate driving circuits are an N-type Metal Oxide Semiconductor (NMOS) transistor and a P-type Metal Oxide Semiconductor (PMOS) transistor respectively.

4. A liquid crystal display device, comprising a liquid crystal display panel and a driving device, the driving device comprising:

a plurality of source driving circuits, wherein each source driving circuit is configured to provide a positive polarity voltage or a negative polarity voltage to a source line of the liquid crystal display panel in a row inversion driving mode;

a plurality of gate driving circuits, wherein each gate driving circuit is configured to provide a gate driving signal to a gate line of the liquid crystal display panel; and a control circuit, wherein when a same image frame is displayed, the control circuit enables a first time period during which the positive polarity voltage is provided to the source line to be less than a second time period during which the negative polarity voltage is provided to the source line, and enables a duration during which the gate driving signal is provided to the gate driving circuit to be larger than or equal to the second time period;

wherein a sum of the first time period and the second time period is a constant value; and wherein a difference between the second time period and the first time period is larger than a preset time threshold;

wherein the preset time threshold is larger than a difference between a second charging time and a first charging time; and wherein the first charging time is a time during which a pixel is fully charged when the positive polarity voltage serves as a charging voltage, and the second charging time is a time during which the pixel is fully charged when the negative polarity voltage serves as the charging voltage.

5. The liquid crystal display device according to claim 4, wherein the control circuit comprises:

a plurality of switching elements corresponding to the plurality of gate driving circuits one-to-one, each gate driving circuit providing a gate driving signal to a corresponding gate line through a corresponding switching element, and two switching elements corresponding to two adjacent gate driving circuits being an NMOS transistor and a PMOS transistor respectively; and control units for controlling on/off states of the switching elements.

* * * * *